US005264841A

United States Patent [19]

Wagai et al.

[11] Patent Number: 5,264,841

[45] Date of Patent: Nov. 23, 1993

[54] PAGING APPARATUS EQUIPPED WITH A CLOCK FUNCTION

[75] Inventors: Kiyoshi Wagai; Tatsuaki Sekigawa; Mitsuji Shiono; Haruhiko Sato, all of Tokyo, Japan

[73] Assignee: Kabushiki Kaisha Toshiba, Kawasaki, Japan

[21] Appl. No.: 761,663

[22] Filed: Sep. 18, 1991

[30] Foreign Application Priority Data

Sep. 21, 1990 [JP] Japan ..... 2-253117

[51] Int. Cl.[5] ..... G08B 5/22

[52] U.S. Cl. ..... 340/825.44; 340/825.37

[58] Field of Search ..... 340/825.44, 825.47, 340/825.48, 825.26, 825.27, 825.69, 825.72, 311.1, 309.5, 825.37; 358/194.1; 368/47

[56] References Cited

U.S. PATENT DOCUMENTS 4,412,217 10/1983 Willard et al. ..... 340/825.44
4,786,902 11/1988 Davis et al. ..... 340/825.44
4,894,649 1/1990 Davis ..... 340/825.44
5,012,234 4/1991 Dulaney et al. ..... 340/825.44
5,105,189 4/1992 Murai et al. ..... 340/311.1
5,140,310 8/1992 DeLuca et al. ..... 340/825.44

*Primary Examiner*—John K. Peng
*Assistant Examiner*—Robert Gray
*Attorney, Agent, or Firm*—Oblon, Spivak, McClelland, Maier & Neustadt

[57] ABSTRACT

A paging apparatus with a time information generating circuit comprises a combination switch having multiple switch positions in different operation directions, so that a time setting mode is set when a predetermined first operation is performed by the combination switch, and a paging mode is set other operations are performed. When a predetermined second operation is performed with the time setting mode set, time information measured by the time information generating circuit is replaced with time information input by the second operation. Even in the time setting mode, it is checked if a call is made to the apparatus. When there is such a call, a user is informed of this event without ignoring the occurrence of the call.

10 Claims, 13 Drawing Sheets

PAGING APPARATUS EQUIPPED WITH A CLOCK FUNCTION

BACKGROUND OF THE INVENTION

1. Field of the Invention

The present invention relates to a paging apparatus equipped with a clock function to measure the time and display it.

2. Description of the Related Art

As a new type of a pager system, a system has recently been developed in which a base station transmits message information, and one of the paging apparatuses subscribed to this system displays the message information. A paging signal used in this system is exemplified in FIG. 8. As illustrated, one frame is time-divided into a plurality of groups each of which is further time-divided into a synchronization word and a plurality of calling words. In each calling word are inserted an identification (ID) code and a message code.

When calling a paging apparatus, a caller dials a telephone number assigned to the paging apparatus, thus reaching the base station, and transmits message information to the base station. Then the base station generates the ID code preassigned to the selected paging apparatus and the message code which is the message information encoded. The ID code and the message code are inserted into one of empty calling words in that one of multiple groups in one frame to which that paging apparatus belongs before transmission to the paging apparatus.

The paging apparatus may be designed as follows. The paging signal transmitted from the base station is received by a radio circuit through an antenna and demodulated by a demodulation circuit for subsequent application to a control circuit. The control circuit collates the ID code contained in the demodulated paging signal with the self-ID code previously stored in ID-ROM. When a coincidence occurs between the codes, the control circuit recognizes the generation of a call to the apparatus to produce a ringing signal. This ringing signal is applied via a driving circuit to a loudspeaker which is in turn generates a ringing tone, whereby the user is informed that a call has been made to him.

Upon the occurrence of a coincidence between the ID codes, the control circuit receives the message code received following the ID code. After being subjected to an error correcting process, the message code is decoded and the decoded message data is applied to a display driving circuit. Consequently the message is displayed on a liquid crystal display (LCD) by the display driving circuit. Therefore, the user can understand the message from the caller through the liquid crystal display at the time of generation of the call. The display message is erased from the liquid crystal display when the user depresses a stop switch.

Recently, a new type of a paging apparatus has been developed which is equipped with a clock function. This type of a paging apparatus has an integrated clock circuit. Information of time received by this integrated clock circuit during a call waiting period is displayed on a message display. Carrying around this type of a paging apparatus, therefore, the owner can use this apparatus as a clock, which is very convenient.

Conventional paging apparatuses of this type have a mode switch and first and second select switches in addition to a switch to instruct disabling generation of a ringing tone or message display and enabling message display. The mode switch serves to switch between the ordinary paging mode and a time setting mode. The first select switch serves to select a digit, such as hour or minute. The second select switch serves to select the value of the digit, "hour" or "minute," selected by the first select switch. Time setting is executed by combining these switches. The prior art design inevitably results in an increased number of switches, thus enlarging the paging apparatus. As a solution to this shortcoming, the switches may be designed compact, which will however deteriorate the operability.

SUMMARY OF THE INVENTION

It is therefore a primary object of the present invention to provide a paging apparatus capable of setting the time without requiring many switches and deterioration of the operability, thus ensuring a compact design of the apparatus and improving the operability.

It is another object of the present invention to provide a paging apparatus which, when called during time setting, can surely inform a user that a call is made, after setting the time by priority.

It is still another object of the present invention to provide a paging apparatus which, when called during time setting, can take an action against the call by priority to inform the user of that event in real time.

It is a further object of the present invention to provide a paging apparatus which, when called during time setting, can take an action against the call by priority to inform the user of that even in real time, and can resume the time setting after informing of the call is completed.

It is a still further object of the present invention to provide a paging apparatus which, even when called during time setting, can inform the user of the call being made without interrupting the operation to set the time.

To achieve the first object, according to one aspect of the present invention, a paging apparatus, which has a paging function to receive a paging signal transmitted from a base station and inform a user of a call being made when the paging signal is addressed to itself and a clock function, comprises a display to display information of time measured by the clock function, a combination switch, mode setting means, and time-setting control means. The combination switch has at least first, second and third switch positions, the third switch position being different in an operation direction from the first and second switch positions. The mode setting means sets a time setting mode when, with the combination switch at the first position, a predetermined operation to set the combination switch to the third switch position. When the combination switch is at any of the other positions, the mode setting means sets a mode to execute the paging function. With the time setting mode set by the mode setting means, the time-setting control means sets time information, whose input is specified by the switch operation of the combination switch between the first and second switch positions and the switching operation to the third switch position, into the clock function and displays a time setting pattern necessary to input the time information on the display.

With the above structure, a combination of switching the combination switch between the first and second positions and the switching operation to the third position can ensure time setting using only a single combination switch. This feature permits the paging apparatus to be more compact and lighter than the conventional paging apparatus which needs a plurality of switches. Further, since the switch in use need not be made compact, good operability can be maintained.

Another feature of the present invention lies in that, when the combination switch immediately after the paging apparatus is powered on is at the first position and only when a predetermined manipulation of the combination switch to the third position is performed in this condition, the time setting mode for the clock function can be set.

Accordingly, after the mode is changed to the paging mode after activation of the paging apparatus, even manipulating the combination switch to the third position from the first position cannot set the time setting mode unless power is temporarily cut and is given again. Even if, with the paging mode set, the owner operates the combination switch to set the time setting mode by mistake, therefore, the time setting mode will not be set. This feature can prevent the paging operation from being interrupted erroneously.

This invention is further characterized in that the display to display the time information can be used as a display for displaying message information when the paging signal addressed to the apparatus includes that message information.

Accordingly, the display for time information can also serve as the display for a message, making it possible to design the paging apparatus more compact.

To achieve the second object, according to another aspect of the present invention, with the time setting mode set, the paging control is executed in parallel to the time setting control. When calling the apparatus is detected in this condition, information to that effect is stored, and control to inform the owner of the call being made is performed in accordance with the stored contents after the time setting is completed.

According to this invention, therefore, when a call is made to the apparatus during time setting, the owner can be informed of that event without neglecting the call, and can also surely complete the operation for setting the time without interruption. In other words, an operational control can be initiated without ignoring the calling while giving priority to the time setting operation.

To achieve the third object, according a still another aspect of the present invention, with the time setting mode set, the paging control is executed in parallel to the time setting control. When calling the apparatus is detected in this condition, the time setting control is interrupted, and control to inform the owner of the call being made is performed.

According to this invention, therefore, when a call is made to the apparatus during time setting the owner can be informed of that event in real time without disregarding the call. That is, an operational control can be initiated while giving the highest priority to the time setting operation.

To achieve the fourth object, according to a further aspect of the present invention, with the time setting mode set, the paging control is executed in parallel to the time setting control. When calling the apparatus is detected in this condition, control to inform the owner of the call being made is performed after temporarily interrupting the time setting control, and the mode returns to the time setting mode after the call-informing operation is completed.

With this feature, even when a call is made to the apparatus during time setting, the owner can be informed of that event in real time without ignoring the call. In addition, since the mode automatically returns to the time setting mode after the call-informing operation is completed, the owner can resume the operation to set the time in real time without initiating the operation to set the mode to the time setting mode again.

Further, the present invention is characterized in that at the time the time setting control is interrupted, how the time has been adjusted up to that point is stored, so that the condition can be returned to the time adjusting state of the point of that interruption in accordance with the stored contents after the call-informing operation is completed.

This feature can allow the state of the paging apparatus to automatically return to the time adjusting state at the time of interruption of the time setting mode. The owner can therefore resume the operation to set the time without repeating this operation from the start. This permits the time setting to be executed efficiently.

To achieve the fifth object, according to a still further aspect of the present invention, with the time setting mode set, the paging control is executed in parallel to the time setting control. When calling the apparatus is detected in this condition, the owner is informed of the call being made while keeping the time setting mode to display information for setting the time.

Accordingly, the owner can be informed in real time that a call has been made to the apparatus without interrupting the operation to set the time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First Embodiment

Figure 1:
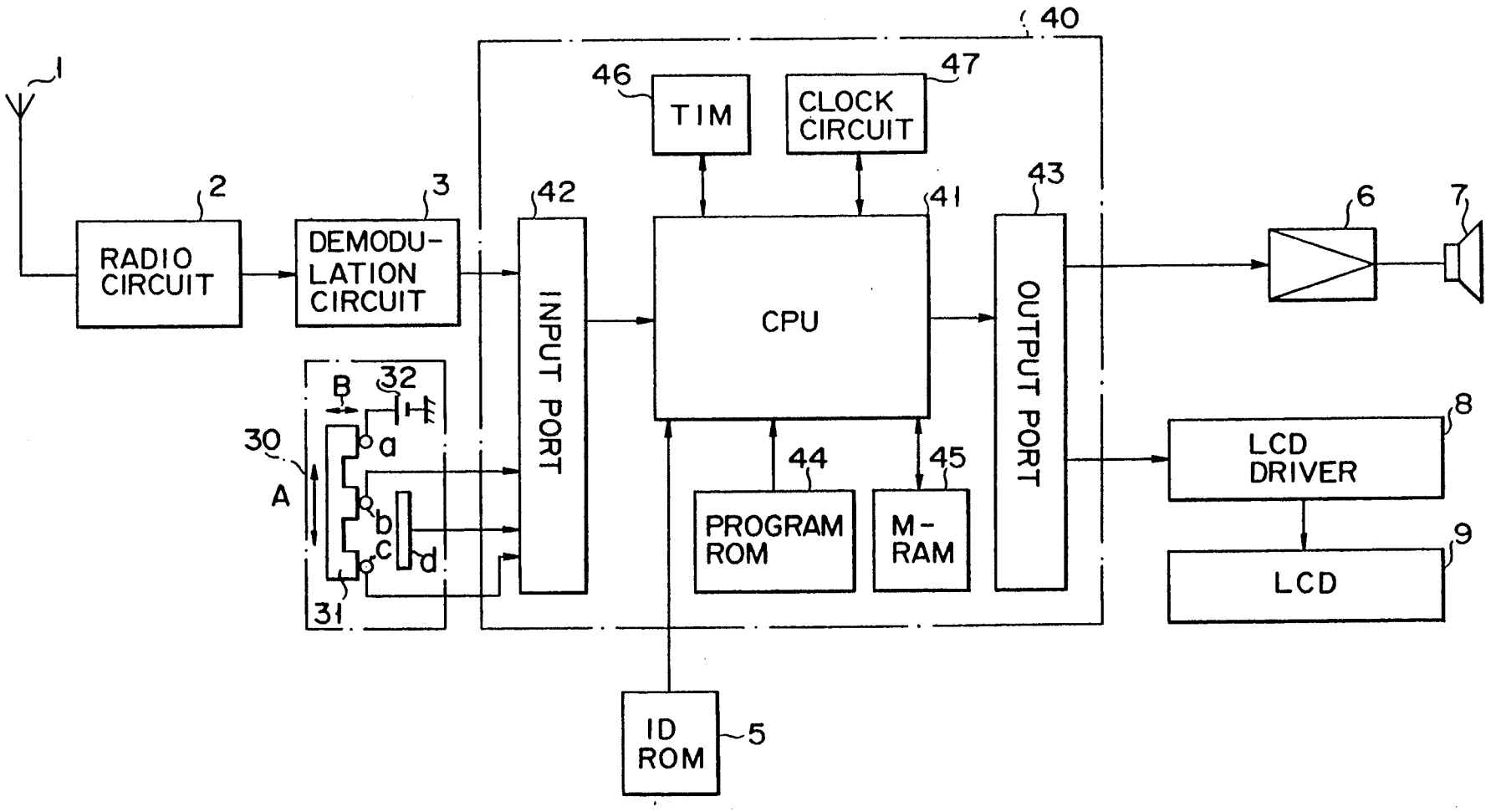
FIG. 1 is a block diagram illustrating the circuit structure of a paging apparatus according to the first embodiment of the present invention.

FIG. 1 is a circuit block diagram of a paging apparatus according to the first embodiment of the present invention.

A paging signal transmitted from a base station (not shown) is received by a radio circuit 2 through an antenna 1 and then applied to demodulation circuit 3 for demodulation. The demodulated paging signal is fed into a control circuit 40 which may be formed of a microcomputer. The microcomputer is provided with a central processing unit (CPU) 41, an input port 42, an output port 43, a program ROM 44, a message memory (M-RAM) 45, a timer TIM 46 and a clock circuit 47.

The CPU 41 executes predetermined control operations in accordance with a program previously stored in the program ROM 44. An ID-ROM 5 is connected to the CPU 41. In ID-ROM 5 is written an ID code previously assigned to each paging apparatus. The message memory 45 is formed of a RAM which has multiple memory areas to store multiple received message codes. The timer 46 is formed of, for example, a programmable counter. The timer 46 receives a count value from the CPU 41. The timer 46 generates a time-out signal upon the passage of a time corresponding to the count value given from the CPU 41, and supplies the time-out signal to the CPU 41. A clock circuit 47 always measures the time, and outputs time information, consisting of "hour," "minute" and "second" data, to the CPU 41. The time-measuring value of the clock circuit 47 may be preset therein by the CPU 41.

To the output port 43 are connected a loudspeaker driver 6 and an LCD driver 8. The loudspeaker driver 6 responds to a driving signal output from the CPU 41 via the output port 43 to produce a ringing signal. This ringing signal is applied to a loudspeaker 7 to generate a ringing tone. In accordance with message data output from the CPU 41 via the output port 43, the LCD driver 8 displays a message corresponding to the message data on a liquid crystal display (LCD) 9.

The demodulation circuit 3 and a combination switch 30 are connected to the input port 42. The combination switch has three slide fixed contacts a, b and c, a depression fixed contact d, an operating member 31 and a bias power supply 32. The depression fixed contact d is provided below the slide fixed contacts b and c. The fixed contact a is grounded via the bias power supply 32. Contact signals at the contacts b, c, and d are sent to the input port 42 in the control circuit 40. The operating member 31 is designed slidable step by step with respect to the slide fixed contacts a, b and c in the direction of A in the diagram. The operating member 31 and fixed contacts a, b and c are also slidable together in the direction of B by depression of the operating member 31, thereby allowing the contacts a, b and c to contact the fixed contact d.

With the above arrangement, the combination switch 30 functions as a power switch, a mode select switch, a volume switch, a ringing tone stop switch and a timer switch.

The operation of the thus constituted paging apparatus will now be described according to the control procedures of the CPU 41.

Figure 2A:
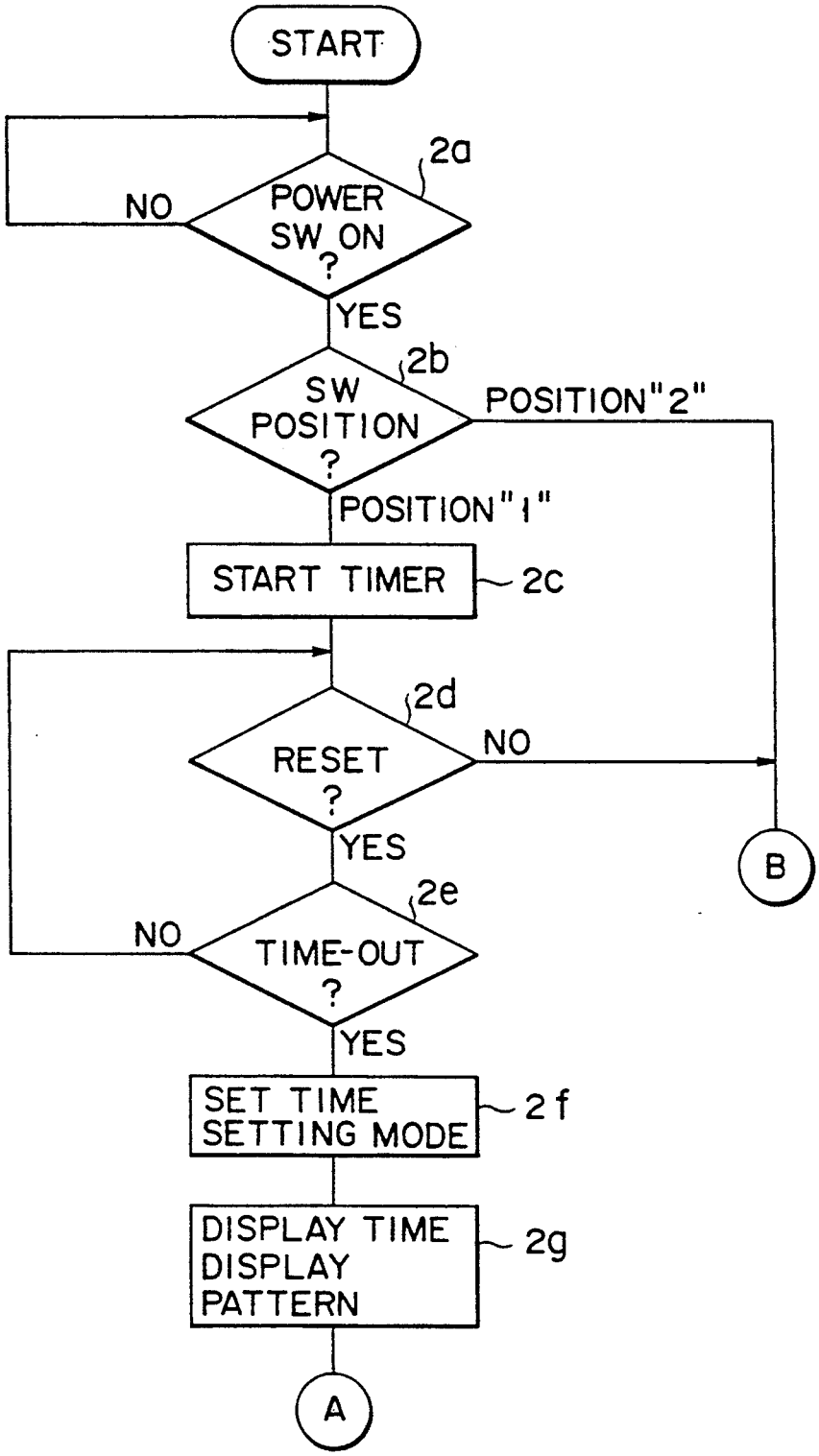
FIGS. 2A and 2B are flowcharts showing the control procedures of a control circuit and contents of control in the paging apparatus shown in FIG. 1.
Figure 2B:
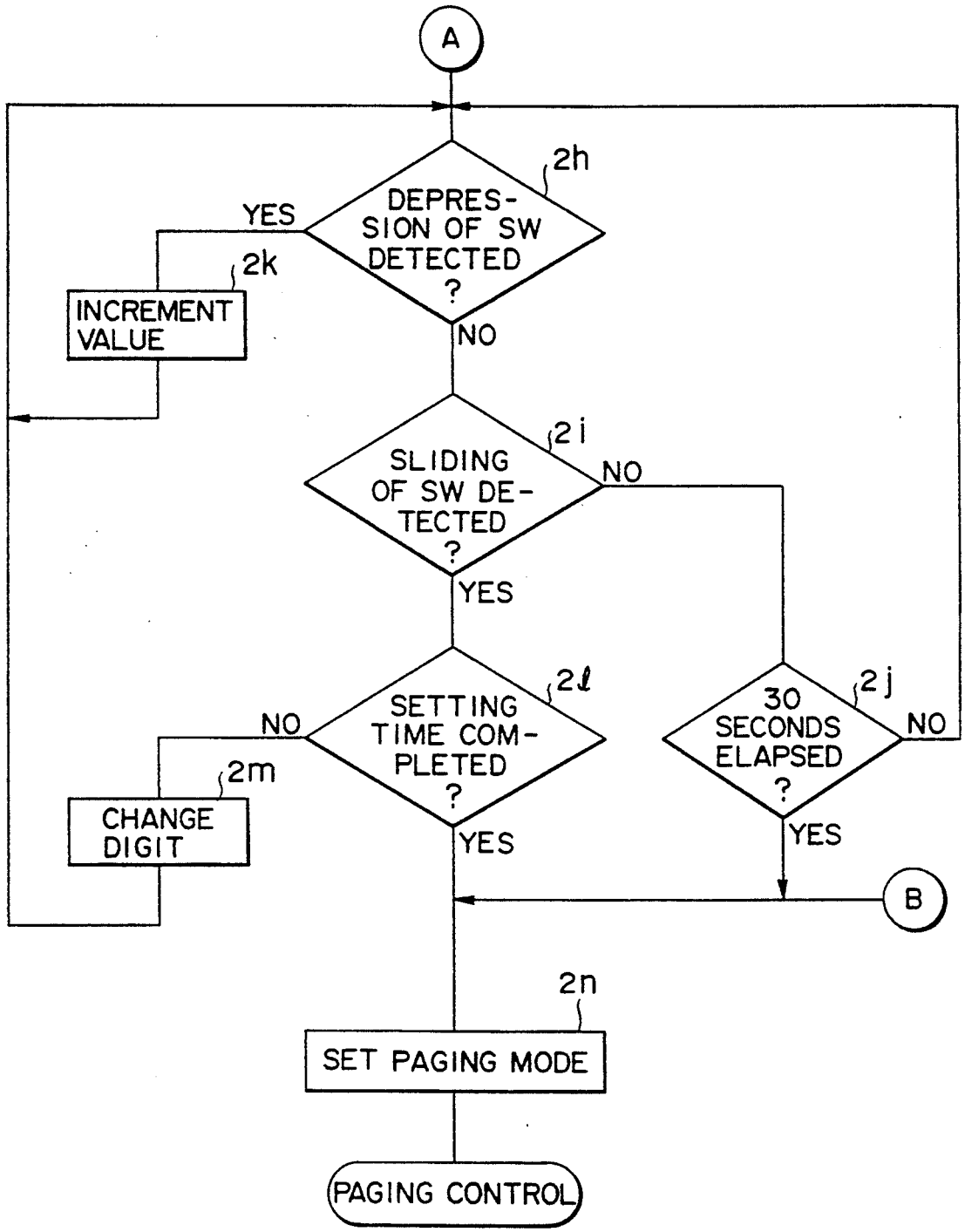
Figure 3:
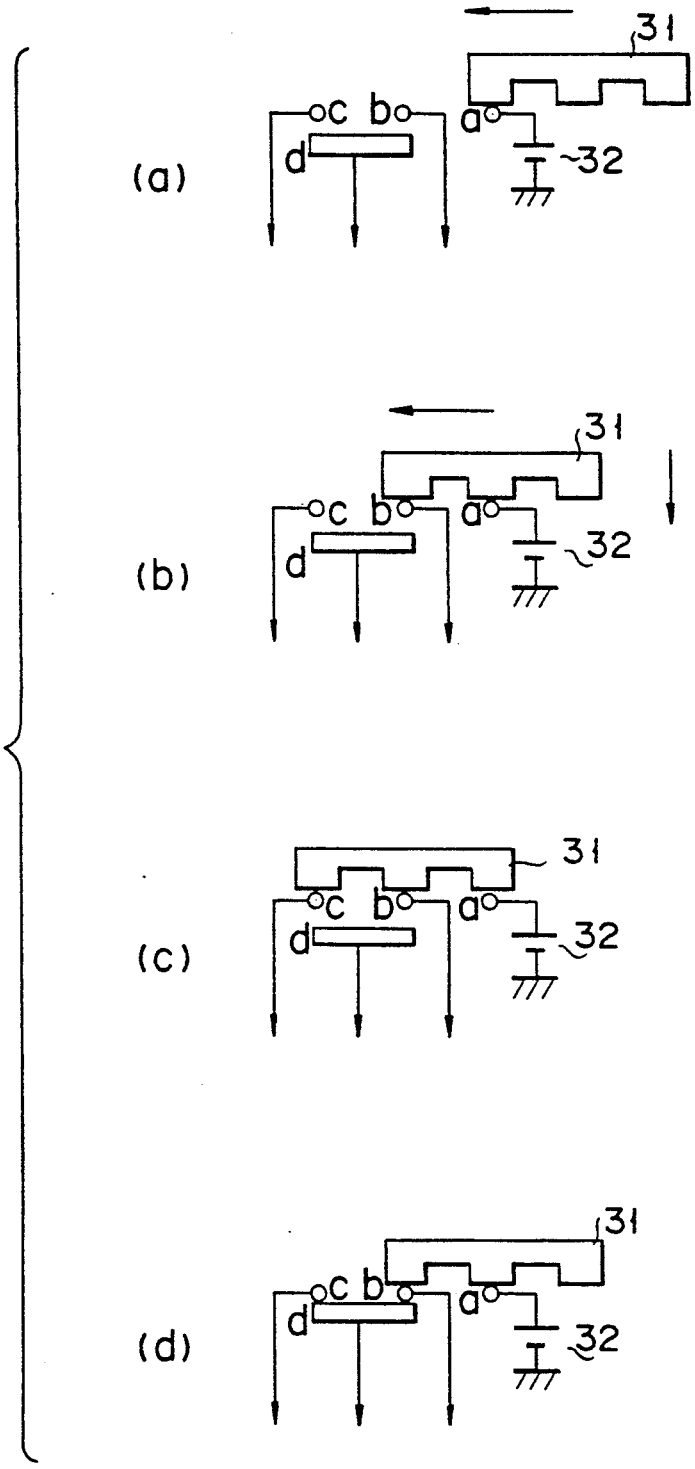
FIG. 3 is a diagram illustrating the operational statuses of a combination switch.

With the paging apparatus inactivated, the operating member 31 of the combination switch 30 is positioned as shown in FIG. 3(*a*). Suppose that the owner slides the operating member 31 from the position shown in FIG. 3(*a*) to the one shown in FIG. 3(*c*). Then, the paging apparatus is powered on, allowing the CPU 41 to start the control. FIGS. 2A and 2B show the control procedures of the CPU 41.

It is detected in step 2*a* that the power is turned on. It is then determined in step 2*b* whether the combination switch 30 is located at the position "1" in FIG. 3(*b*) or at the position "2" in FIG. 3(*c*). When it is located at the position "2," the CPU 41 determines that a paging mode is selected and moves from step 2*b* to step 2*n*. In step 2*n*, the CPU 41 set the paging mode, so that it starts the control necessary for paging operation of a paging signal. In other words, when the paging apparatus is set in real-time paging mode, the user sets the combination switch 30 to the position "2" immediately after the power is on.

Figure 8:
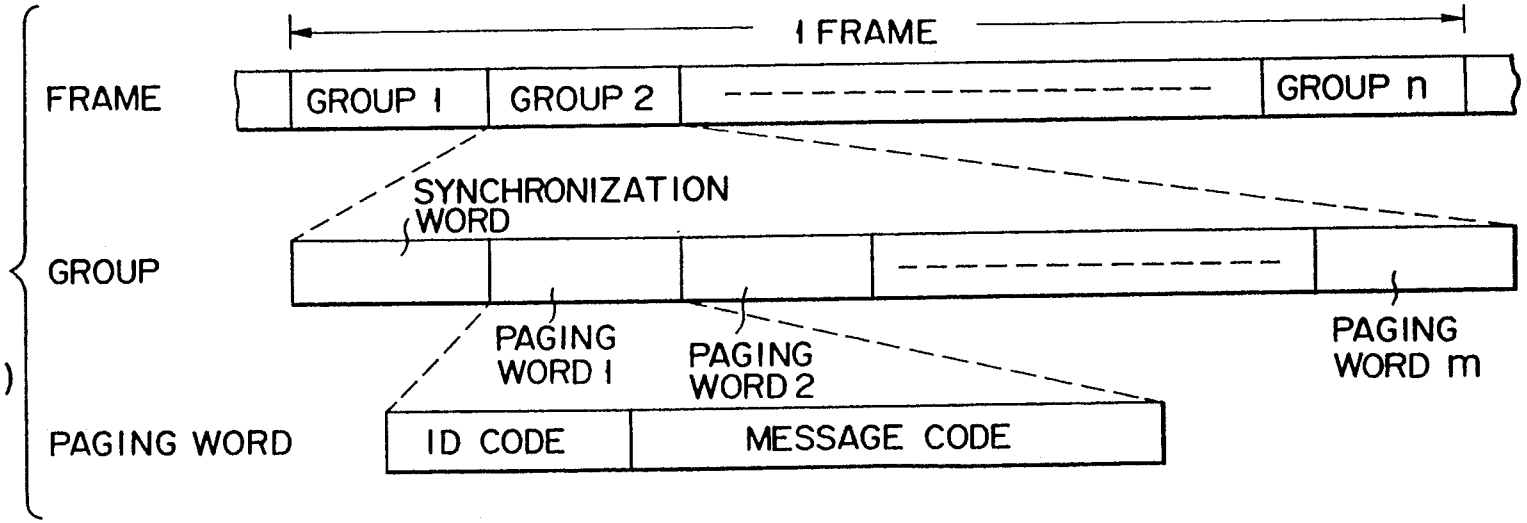
FIG. 8 (PRIOR ART)
FIG. 8 is a diagram exemplifying the format of a conventionally-known paging signal.

The CPU 41 will execute the control in paging mode as follows. In the call wait status, a paging signal is received and demodulated in a reception period of, for example, the group 2, one of the groups in one frame in FIG. 8, where the apparatus belongs. When the group 2 (to which the apparatus belongs) enters its reception period, the CPU 41 collates the ID code included in the paging signal demodulated by the demodulation circuit 3 with the ID code stored in the ID-ROM 5, and determines a coincidence between the two codes.

When a coincidence occurs between both ID codes, a drive signal is first applied to the loudspeaker driver 6. As a result, the loudspeaker driver 6 outputs a ringing signal, causing the loudspeaker 7 to generate a ringing tone. The ringing tone informs the user that a call has been made to him. The CPU 41 then determines whether or not a message code is received. When the receipt of the message code is detected, the message code is sent to the M-RAM 45 to be written into an empty area therein. When there is no empty area in the M-RAM 45, on the other hand, the message code which is the oldest in the order of receipt among message codes already stored in the M-RAM 45 is replaced with the new message code just received. The received message code written in the M-RAM 45 is read from the M-RAM 45 by the CPU 41 to be sent to the LCD driver 8. A message corresponding to the received message code is displayed on the LCD 9. The user can therefore understand the message from the caller by watching the LCD 9.

When the user depresses the combination switch 30 at this time, the CPU 41 supplies a stop signal to the loudspeaker driver 6, causing the loudspeaker 7 to stop the ringing tone. Further, when the user depresses the combination switch 30 again, the CPU 41 sends a stop signal to the LCD driver 8, erasing the message on the LCD 9.

Likewise, whenever the reception period comes for the group where the apparatus belongs, the CPU 41 collates the received ID code with the self ID code. When they are coincident to each other, the CPU 41 controls generation of the ringing tone and the display of the received message.

When the CPU 41 has determined in step 2*b* that the combination switch 30 is set at the position "1" in FIG.

3(*b*), the CPU 41 supplies a count value corresponding to, for example, three seconds and a start signal to the timer 46, which in turn starts counting three seconds. The CPU 41 repeatedly performs step 2*d* of determining if the combination switch 30 has been sequentially depressed as a reset operation, and step 2*e* of monitoring the time-out of the timer 46. If the CPU 41 determines that the reset operation is not at all executed, or that the reset operation is completed before the time-out of the timer 46 occurs, the flow moves from step 2*d* to step 2*n*. The paging mode is set in step 2*n* as described previously, and the control necessary for the paging operation of the paging signal starts.

Suppose that the owner continues depressing the combination switch 30 three seconds or longer while the switch 30 is at the position "1" shown in FIG. 3(*d*). The CPU 41 then determines that this operation is requesting that the time setting mode be set, advancing to step 2*f*. The time setting mode is set in step 2*f* and the time setting control is performed as follows.

The CPU 41 supplies a time display pattern of "hour," "minute" and "second" to the LCD driver 8 in step 2*g*, so that the time display pattern is displayed on the LCD 9. In this case, one of the digits of the time display pattern, for example, "hour," is blinked. In steps 2*h*, 2*i* and 2*j*, it is repeatedly detected whether the depression and sliding of the combination switch 30 has been performed, and if a predetermined period of time (e.g. 30 seconds) has elapsed after the last operation of the switch. If the combination switch 30 is depressed, the displayed number on the digit of "hour" is incremented in step 2*k*. The owner can therefore vary the number on the "hour" digit by depressing the combination switch 30, selecting the desired "hour."

Suppose the owner slides the combination switch 30 from the state in FIG. 3(*b*) to the state in FIG. 3C, and then returns the switch 30 to the position in FIG. 3D. The CPU 41 then determines that all the setting for the "hour" digit is completed, and advances to step 21. The CPU 41 then determines in step 21 if setting numerals for all the digits is completed, i.e., whether setting the time is completed. If the setting is determined incomplete, the blinking digit is changed to the next digit, "minute," in step 2*m*. The flow then returns to the monitoring control in steps 2*h* to 2*j*. The desired numbers are likewise selected and set to both digits, "minute" and "second," by combining the depression and sliding of the combination switch 30.

When setting for the digit of "second," the CPU 41 judges in step 21 that the time setting has been completed, moving to step 2*n*. In step 2*n*, the time setting mode is released, the paging mode is newly set to start the above-described paging control thereafter.

In the process of selecting and setting the numbers for "hour," "minute" and "second" in step 2*h* to 2*j*, if the combination switch 30 is not operated even after 30 seconds has elapsed from the last operation of the switch 30, the CPU 41 detects this in step 2*j*, and goes to step 2*n*. In this step, the CPU 41 alters the time setting mode to the paging mode, and enters the paging control.

Second Embodiment

A paging apparatus according to this embodiment executes the paging control in parallel to the time setting control while the time setting mode is set. When calling the apparatus is detected in this condition, information to that effect is stored, and control to inform the owner of the call being made is performed in accordance with the stored contents after the time setting is completed.

Figure 4A:
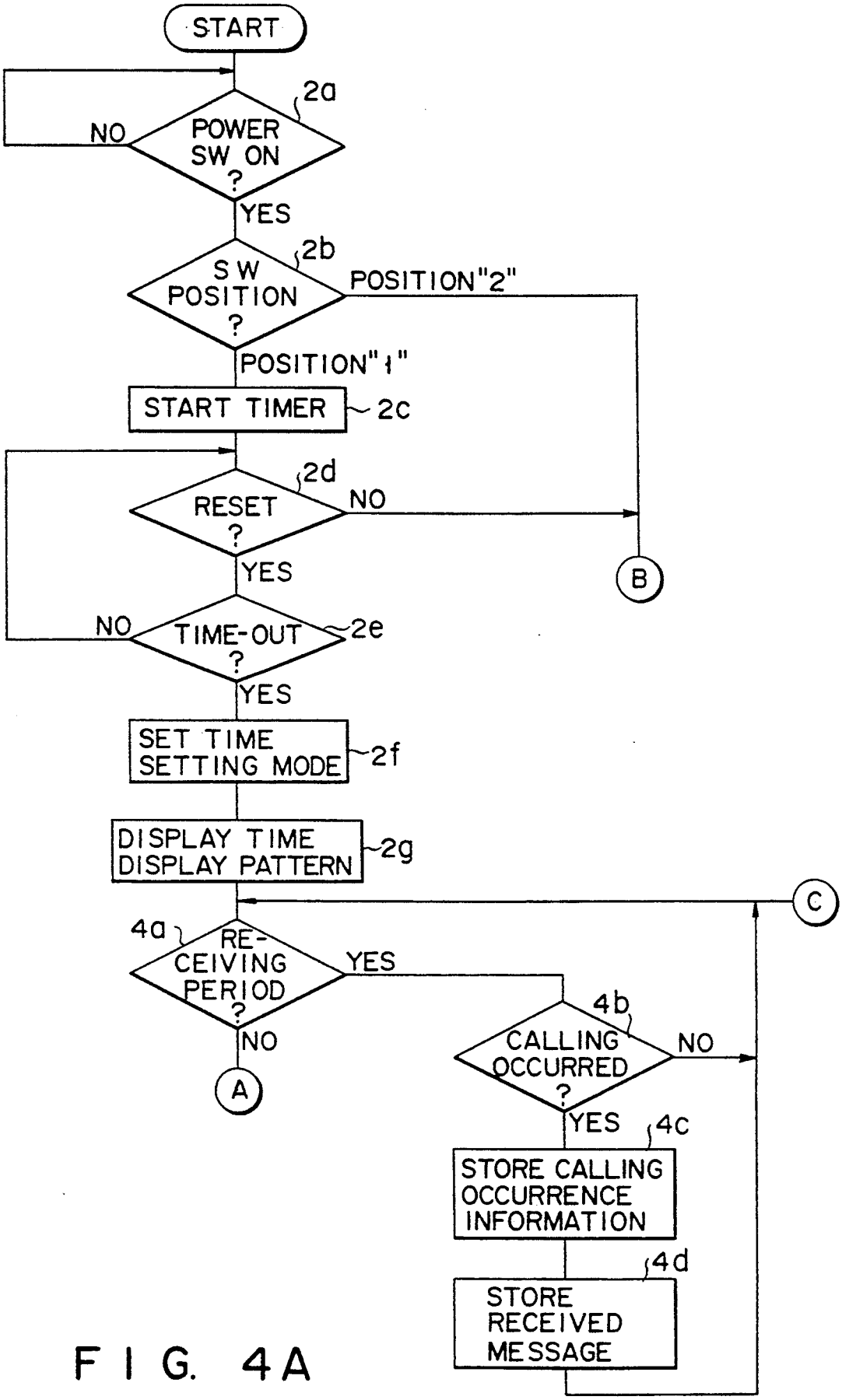
FIGS. 4A and 4B are flowcharts representing the control procedures of a control circuit and contents of control in a paging apparatus according to the second embodiment of the present invention.
Figure 4B:
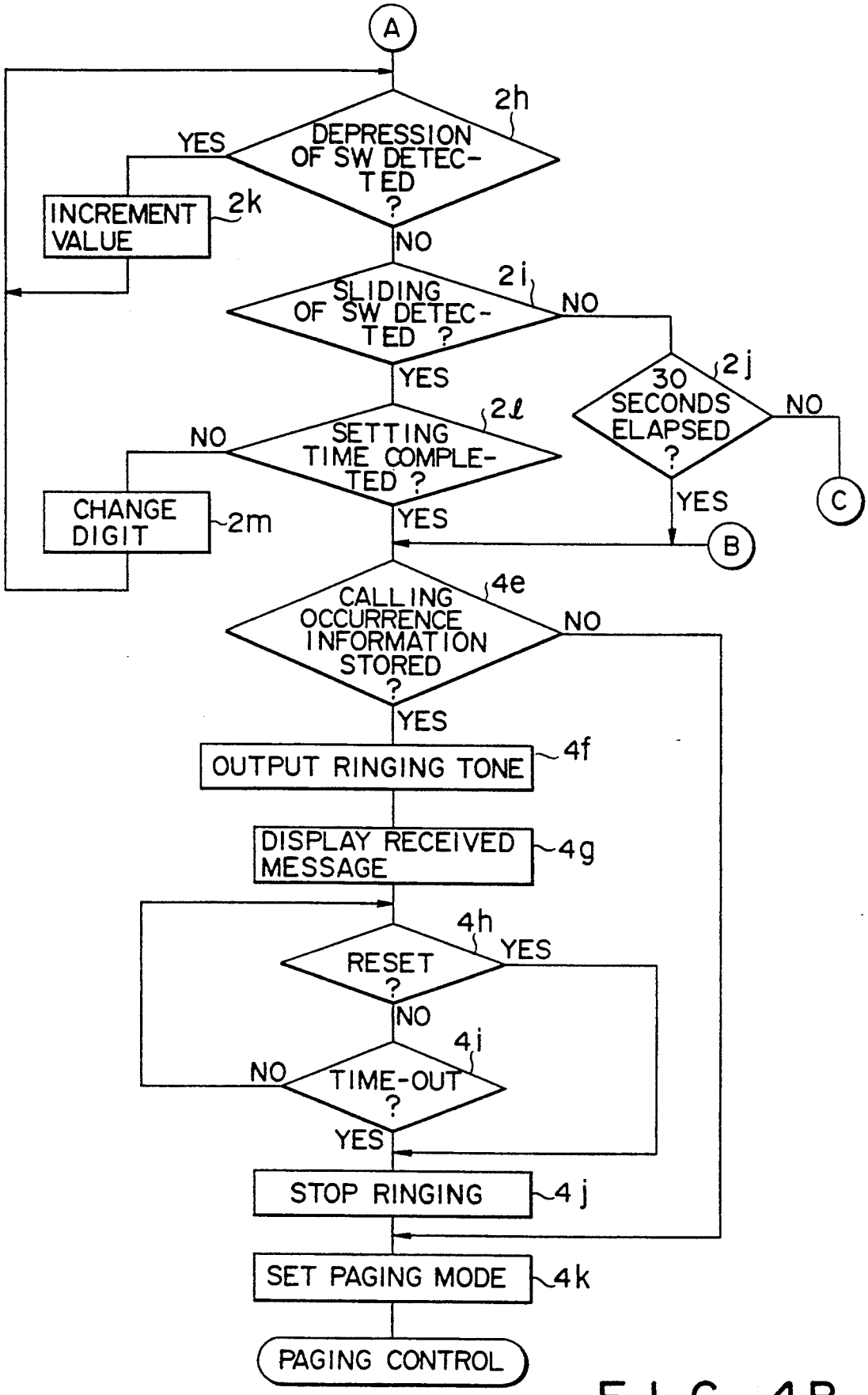

FIGS. 4A and 4B are flowcharts illustrating the control procedures of the CPU 41 in the paging apparatus according to the second embodiment, and the contents of the control. In these diagrams, those portions identical to what is illustrated in FIGS. 2A and 2B are given like reference numerals to avoid their redundant description.

After the CPU 41 sets the time setting mode in step 2*f* and displays a time display pattern on the LCD 9 in step 2*g*, the CPU 41 determines in step 4*a* whether or not it is a reception period for that group where the apparatus belongs. When it is the reception period for the group to which the apparatus belongs, the CPU 41 moves from step 4*a* to step 4*b* to determine if a call has been made. As described earlier, this decision is made by collating the received ID code with the ID code of the apparatus stored in the ID-ROM 5.

When judging that the call has been made to the apparatus, the CPU 41 stores information representing the occurrence of the call into the register in the CPU 41 in step 4*c*, and writes the received message code in the M-RAM 45 in step 4*d*. After writing the received message is completed, the CPU returns to step 4*a*. That is, when a call is made while setting the time setting mode, the CPU 41 simply stores the information of the call being made and the received message code, and resumes the control to set the time.

If the reception period is for other group than the one to which the apparatus belongs, the CPU 41 moves from step 4*a* to step 2*h* shown in FIG. 4B, and executes the time setting control, described earlier referring to FIG. 2B, thereafter.

When the end of the time setting operation is checked in step 21 in the time setting control, the CPU 41 then determines in the subsequent step 4*e* whether or not information representing a call being made is stored in the register in the CPU 41. When such information exists in the register, the CPU 41 generates a ringing tone from the loudspeaker 7 in step 4*d*, and then displays the received message on the LCD 9 in step 4*g*. In this condition, the CPU 41 repeatedly determine whether the depressing the combination switch 30 initiates the reset operation (step 4*h*) and whether the duration of the generation of the ringing tone has exceeded a predetermined period of time (e.g., five seconds) (step 4*i*). When the reset operation is initiated within five seconds or five seconds has elapsed even if the reset operation is not initiated, the CPU 41 moves to step 4*j* to stop generating the ringing tone. It is to be noted that the received message displayed on the LCD 9 is erased when the owner initiates the reset operation again by pressing the combination switch 30 or a predetermined period of time (e.g., ten seconds) elapses.

When the ringing tone stops and displaying the received message stops, the CPU 41 sets the paging mode in step 4*k*, and starts control only for the paging operation thereafter.

According to this embodiment, control to monitor the occurrence of a call even while the time setting mode is set, and when a call is made to the apparatus during time setting, a ringing tone is generated and the received message is displayed after the time setting is completed. Even if a call is made during the time setting, it is possible to detect this call and inform the owner of that event without neglecting the call. Since the call-informing operation is initiated after completing the time setting operation, the latter operation can be completed without interruption. In other words, an operational control can be initiated without ignoring the calling while giving priority to the time setting operation.

Third Embodiment

A paging apparatus according to this embodiment executes the paging control in parallel to the time setting control while the time setting mode is set. When calling the apparatus is detected in this condition, the time setting control is stopped, and control to inform the owner of the call being made is performed.

Figure 5A:
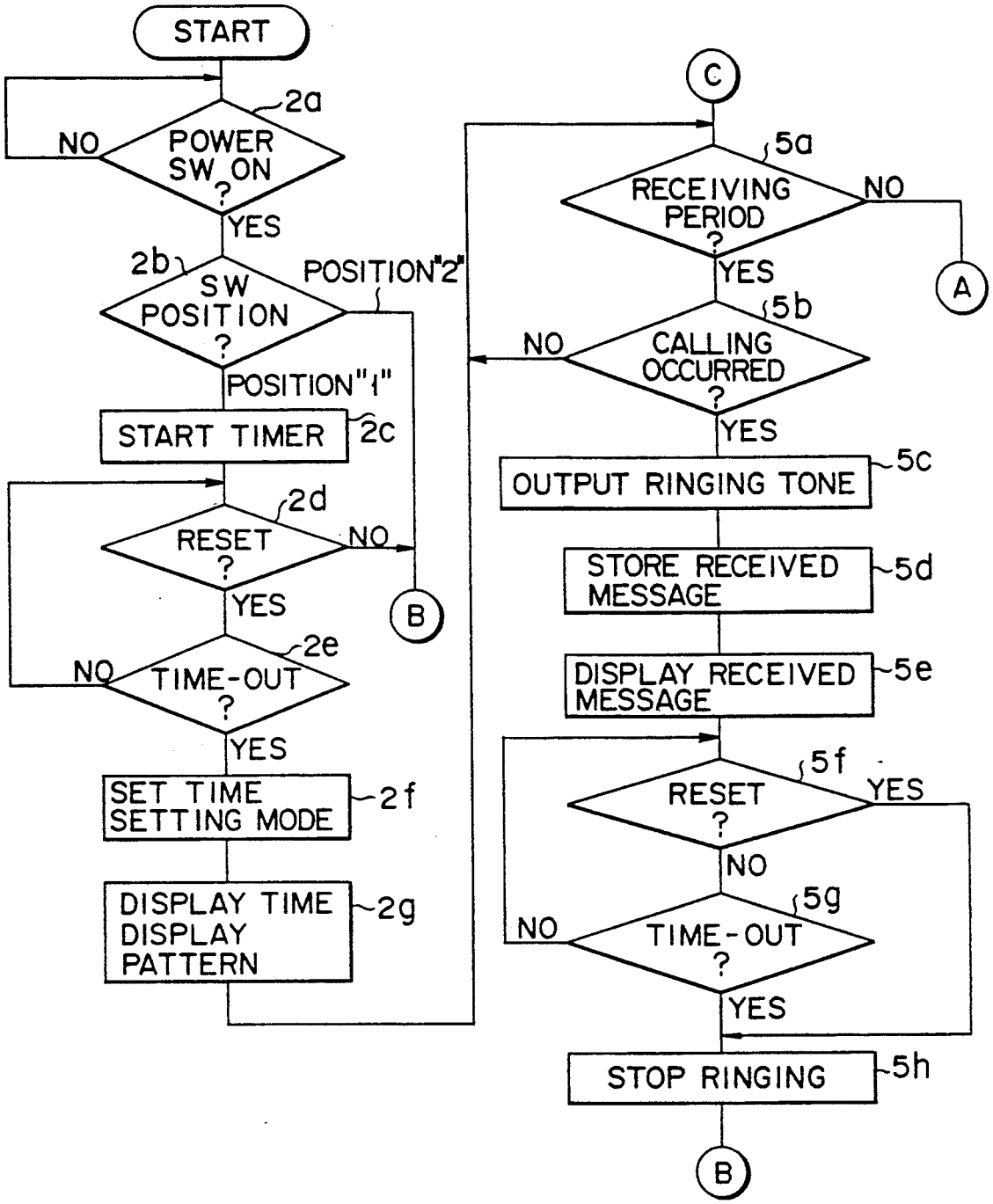
FIGS. 5A and 5B are flowcharts showing the control procedures of a control circuit and contents of control in a paging apparatus according to the third embodiment of the present invention.
Figure 5B:
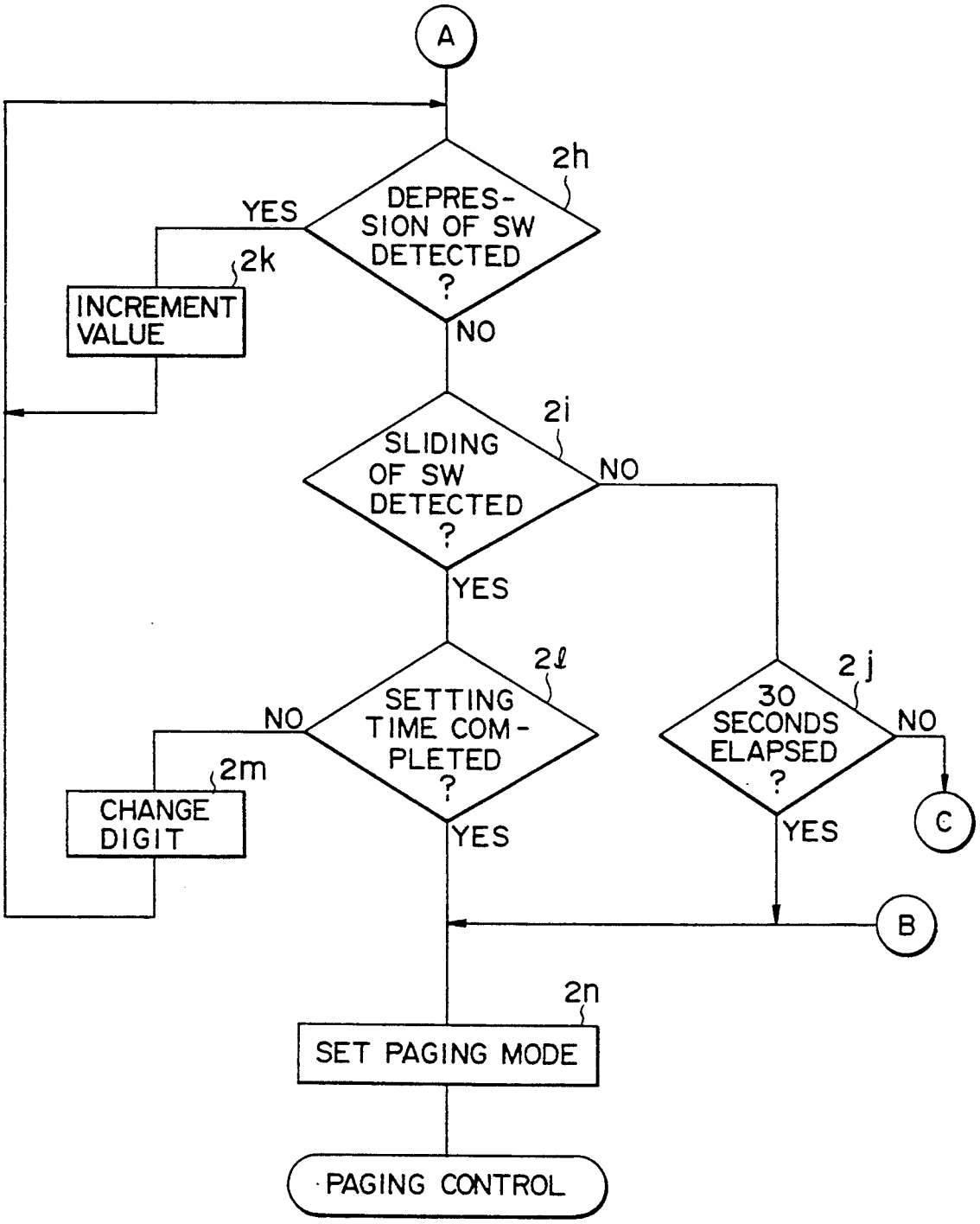

FIGS. 5A and 5B are flowcharts illustrating the control procedures of the CPU 41 in the paging apparatus according to the third embodiment, and the contents of the control. In these diagrams, those portions identical to what is illustrated in FIGS. 2A and 2B are given like reference numerals to avoid their redundant description.

After the CPU 41 sets the time setting mode in step 2*f* and displays a time display pattern on the LCD 9 in step 2*g*, the CPU 41 determines in step 5*a* whether or not it is a reception period for that group where the apparatus belongs. If the reception period is for other group than the one to which the apparatus belongs, the CPU 41 moves from step 5*a* to step 2*h* shown in FIG. 5B, and executes the time setting control in steps 2*h* to 2*n* thereafter. The determination of the reception period in step 5*a* is included in the control procedures for setting the time.

When it is the reception period for the group to which the apparatus belongs, the CPU 41 moves from step 5*a* to step 5*b* to determine if a call has been made. As described earlier, this decision is made by collating the received ID code with the ID code of the apparatus stored in the ID-ROM 5. When judging in step 5*b* that the call to the apparatus has been made, the CPU 41 releases the current time setting mode at this time, and generates a ringing tone from the loudspeaker 7 in step 5*c*. The CPU 41 writes a received message code in the M-RAM 45 in step 5*d*, and reads the received message code from the M-RAM 45 in step 5*e* to supply the code to the LCD driver 8. The received message code is then displayed on the LCD 9. In this condition, the CPU 41 repeatedly determines whether the depressing the combination switch 30 initiates the reset operation (step 5*f*) and whether the duration of the generation of the ringing tone has exceeded a predetermined period of time (e.g., five seconds) (step 5*g*). When the reset operation is initiated within five seconds or five seconds has elapsed even if the reset operation is not initiated, the CPU 41 moves to step 5*h* to stop generating the ringing tone. It is to be noted that the received message displayed on the LCD 9 is erased when the owner initiates the reset operation again by pressing the combination switch 30 or a predetermined period of time (e.g., ten seconds) elapses.

When the ringing tone stops and displaying the received message stops, the CPU 41 sets the paging mode in step 2*n* in FIG. 5B, and starts control only for the paging operation thereafter.

According to this embodiment, control to monitor the occurrence of a call even while the time setting mode is set, and when a call is made, a time setting mode is then released, a ringing tone is immediately generated and the received message is displayed. Even if a call is made during the time setting, it is possible to detect this call and inform the owner of that event without neglecting the call. Further, since a call is immediately informed as soon as the occurrence of a call is detected, it is possible to promptly cope with an emergency call if occurred. In other words, the control can be executed with the call information prior to all others.

Fourth Embodiment

A paging apparatus according to this embodiment executes the paging control in parallel to the time setting control while the time setting mode is set. When calling the apparatus is detected in this condition, the time setting control is stopped, control to inform the owner of the call being made is performed, and the paging apparatus is returned in time setting mode after the information.

Figure 6A:
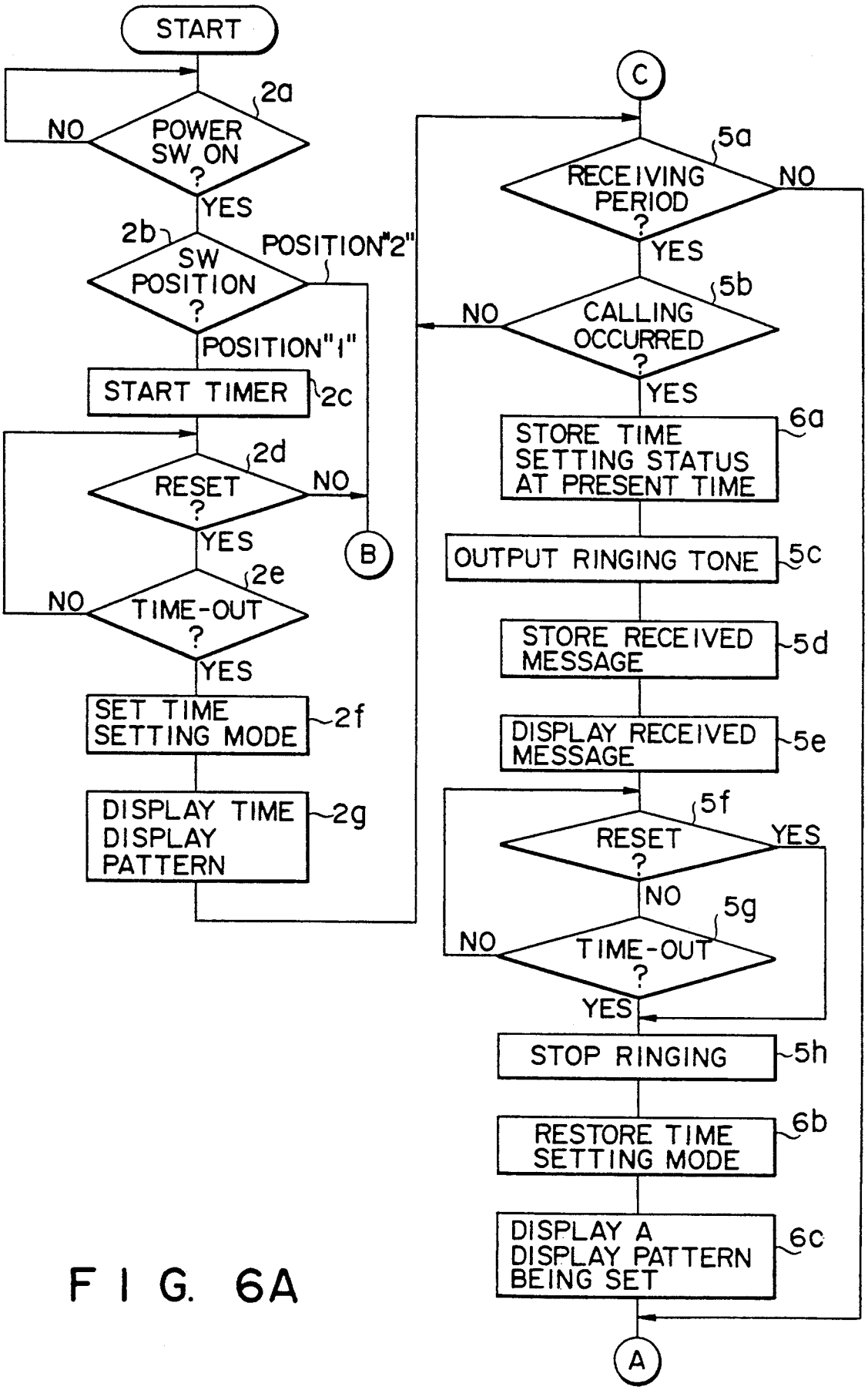
FIGS. 6A and 6B are flowcharts representing the control procedures of a control circuit and contents of control in a paging apparatus according to the fourth embodiment of the present invention.
Figure 6B:
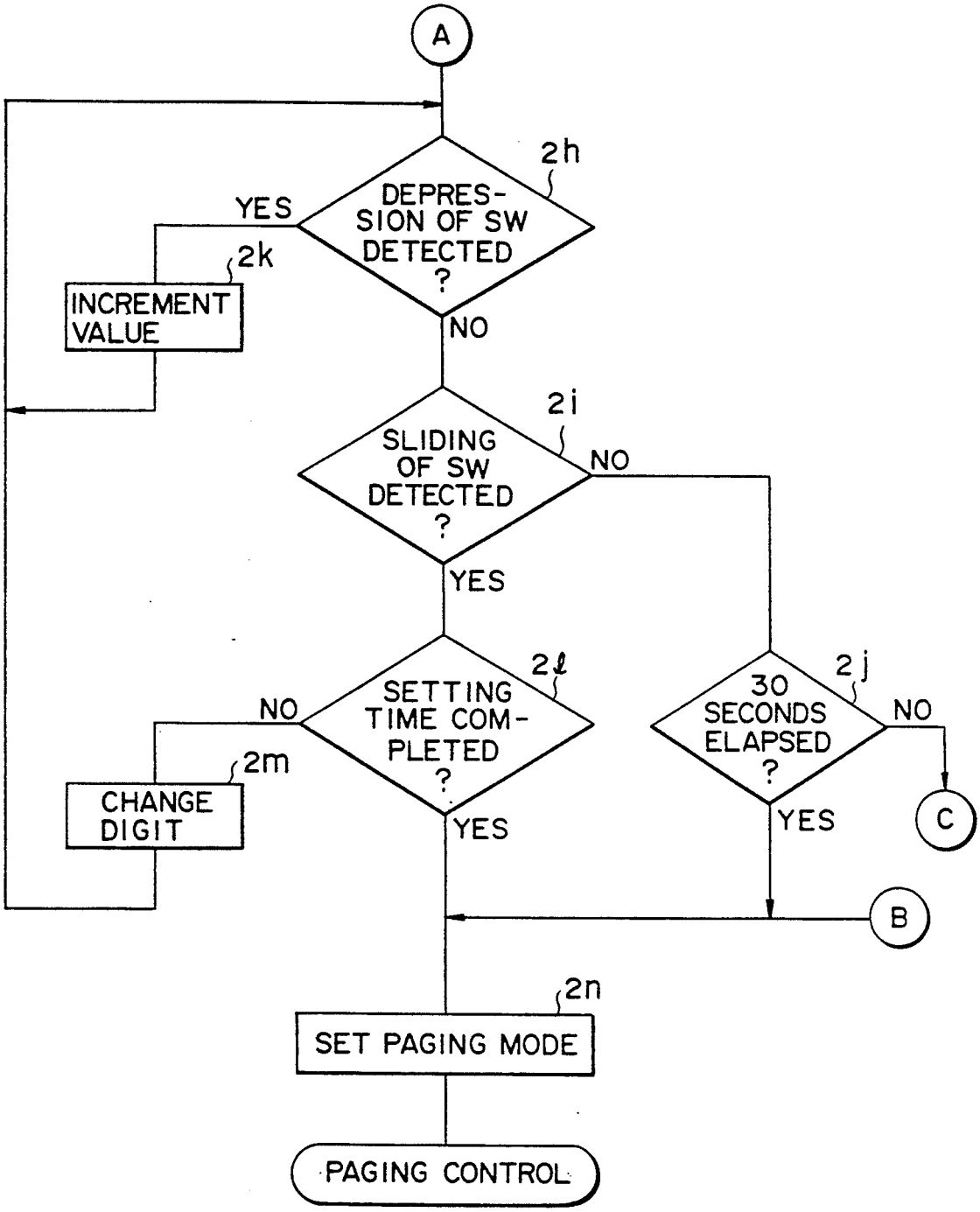

FIGS. 6A and 6B are flowcharts illustrating the control procedures of the CPU 41 in the paging apparatus according to the third embodiment, and the contents of the control. In these diagrams, those portions identical to what is illustrated in FIGS. 5A and 5B are given like reference numerals to avoid their redundant description.

After the CPU 41 sets the time setting mode in step 2*f* in FIG. 6 and displays a time display pattern on the LCD 9 in step 2*g*, the CPU 41 determines in step 5*a* whether or not it is a reception period for that group where the apparatus belongs. If the reception period is for other group than the one to which the apparatus belongs, the CPU 41 moves from step 5*a* to step 2*h* shown in FIG. 6B, and executes the time setting control in steps 2*h* to 2*n* thereafter. The determination of the reception period in step 5*a* is included in the control procedures for setting the time.

When it is the reception period for the group to which the apparatus belongs, the CPU 41 moves from step 5*a* to step 5*b* to determine if a call has been made. As described earlier, this decision is made by collating the received ID code with the ID code of the apparatus stored in the ID-ROM 5.

When judging in step 5*b* that a call to the apparatus has been made, the CPU 41 stores information of the current time setting status to the RAM of the CPU 41 in step 6*a*. The information of the time setting status indicates how the time setting has progressed. For example, if the operation has progressed to time setting for the digit "minute" at this time, a number of the "minute" is stored as information indicating the time setting status. The CPU 41 then releases the current time setting mode, and generates a ringing tone from the loudspeaker 7 in step 5*c*. The CPU 41 writes a received message code in the M-RAM 45 in step 5*d*, and reads the received message code from the M-RAM 45 in step 5*e* to supply the code to the LCD driver 8. The received message code is then displayed on the LCD 9. In this condition, the CPU 41 repeatedly determines whether the depressing the combination switch 30 initiates the reset operation (step 5*f*) and whether the duration of the generation of the ringing tone has exceeded a predetermined period of time (e.g., five seconds) (step 5*g*). When the reset operation is initiated within five seconds or five seconds has elapsed even if the reset operation is not initiated, the CPU 41 moves to step 5*h* to stop generating the ringing tone. It is to be noted that the received message displayed on the LCD 9 is erased when the owner initiates the reset operation again by pressing the combination switch 30 or a predetermined period of time (e.g., ten seconds) elapses.

When the ringing tone stops and displaying the received message stops, the CPU 41 sets a time setting mode again. Based on the information of the time setting status stored in the RAM of the CPU 41, a time display pattern being set is displayed on the LCD 9 in step 6c. If a call has been made while the digit "minute" is being set, the current number of its digit is displayed blinking on the LCD 9. The CPU 41 advances to step 2h in FIG. 6B thereafter, and starts control only for the time setting operation in steps 2h to 2n thereafter.

According to this embodiment, like the third embodiment, control to monitor the occurrence of a call even while the time setting mode is set, and when a call is made, a time setting mode is then released, a ringing tone is immediately generated and the received message is displayed. Even if a call is made during the time setting, it is possible to detect this call and inform the owner of that event without neglecting the call. Further, since a call is immediately informed as soon as the occurrence of a call is detected, it is possible to promptly cope with an emergency call occurring.

According to this embodiment, since a mode is automatically returned to a time setting mode after the call-informing operation is completed, and a time setting status is also returned to immediately before the call has been made, the owner can resume the time setting operation from where he or she has stopped after confirming the occurrence of the call. The owner does not have to start the time setting operation from the beginning, and can efficiently proceed the time setting. If the mode is shifted to the paging mode after the call-informing operation is completed, the time setting mode should be set again by operating the combination switch 30 to temporarily turn the power off and then turn it on again, and continuously depressing the combination switch 30 for a given period of time (three seconds). Further, the time setting should be performed from the beginning in this case; i.e., the operation should start with the digit of "hour." This operation is very troublesome.

Fifth Embodiment

A paging apparatus according to this embodiment executes the paging control in parallel to the time setting control while the time setting mode is set. When calling the apparatus is detected in this condition, the owner is informed of the call being made while keeping display for setting the time while the time setting mode is maintained.

Figure 7A:
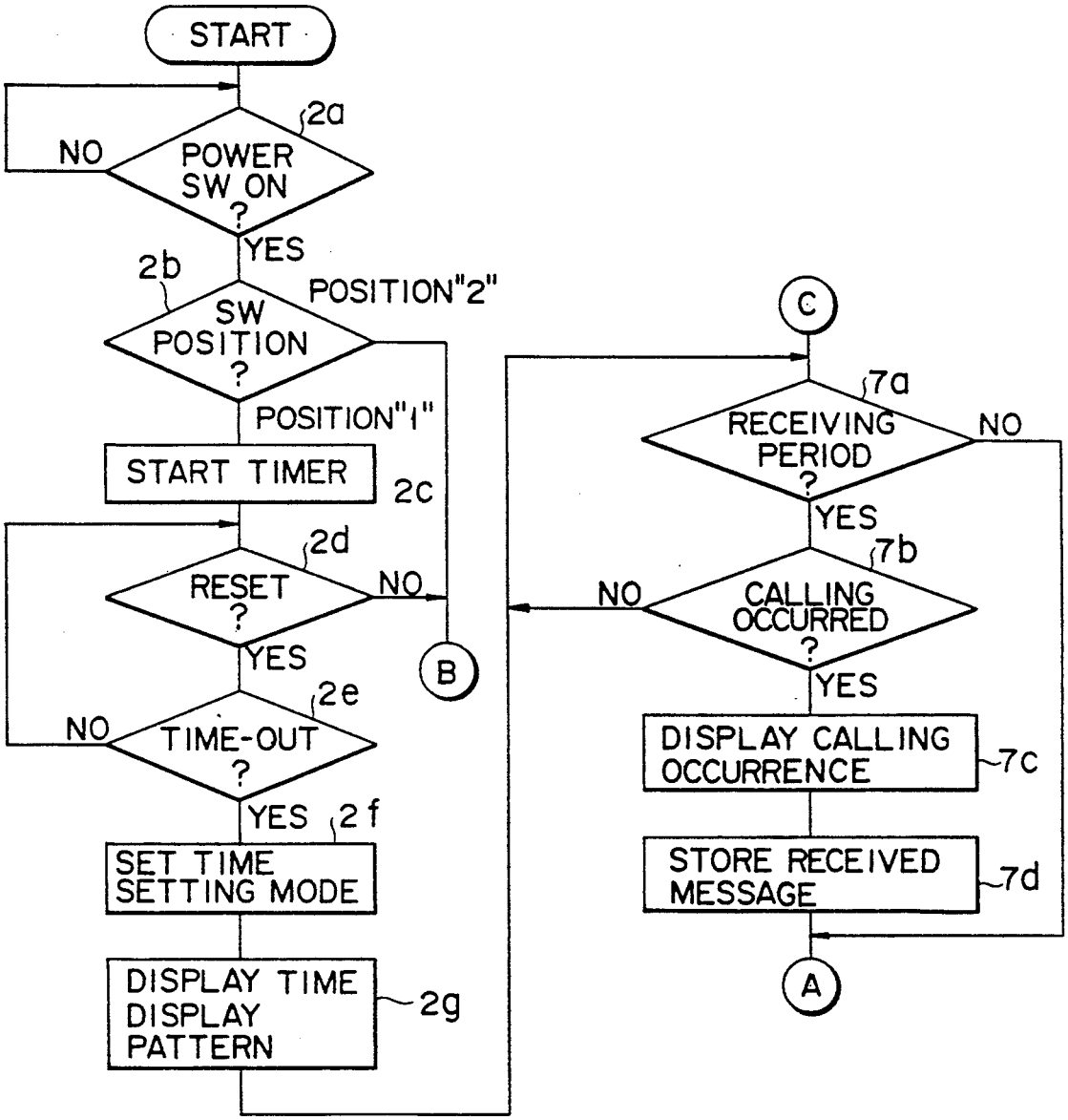
FIGS. 7A and 7B are flowcharts representing the control procedures of a control circuit and contents of control in a paging apparatus according to the fifth embodiment of the present invention.
Figure 7B:
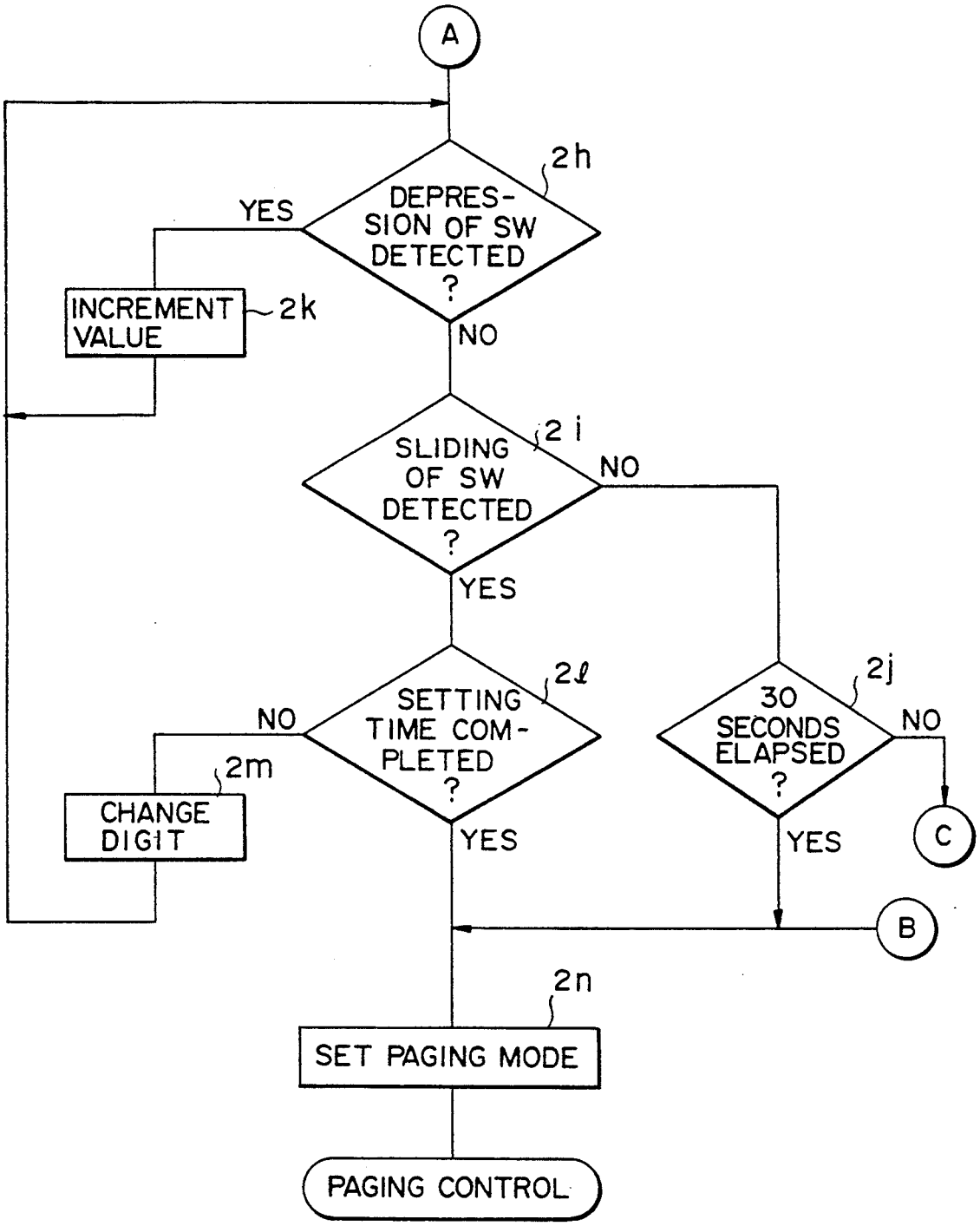

FIGS. 7A and 7B are flowcharts illustrating the control procedures of the CPU 41 in the paging apparatus according to the fifth embodiment, and the contents of the control. In these diagrams, those portions identical to what is illustrated in FIGS. 2A and 2B are given like reference numerals to avoid their redundant description.

After the CPU 41 sets the time setting mode in step 2f and displays a time display pattern on the LCD 9 in step 2g, the CPU 41 determines in step 7a whether or not it is a reception period for that group where the apparatus belongs. When it is the reception period for the group to which the apparatus belongs, the CPU 41 moves from step 7a to step 7b to determine if a call has been made. As described earlier, this decision is made by collating the received ID code with the ID code of the apparatus stored in the ID-ROM 5.

When judging in step 7b that the call has been made to the apparatus, the CPU 41 causes the LCD 9 to display information repressing the occurrence of a call while displaying the time display pattern for setting the time. For instance, a mark indicating the occurrence of the call is displayed blinking on an unused or blank portion of the screen on the LCD 9. The owner viewing the LCD 9 to set the time can very easily see the blinking mark.

Then, the CPU 41 writes the received message code in the M-RAM 45 in step 7d. When writing the received message is completed, control is shifted to control to set the time as shown in FIG. 7B. The received message stored in the M-RAM 45 is read out therefrom and displayed on the LCD 9 after the paging mode is set in step 2n after completion of the time setting operation. At this time, the mark may be erased when the paging mode is set, or may be kept displayed even after displaying the received message starts.

According to this embodiment, as described above, when a call is made during time setting, a mark indicating the occurrence of the call is displayed blinking on a blank portion of the screen on the LCD 9 while keeping displaying the time display pattern for setting the time on the LCD 9, so that the owner can in real time confirm the occurrence of the call without interrupting at all the operation of setting the time.

The present invention is not limited to the above-described embodiments. For instance, while a mark is displayed blinking on the LCD 9 to inform the owner of the occurrence of a call in the fifth embodiment, a ringing tone may be generated instead for a given period of time (e.g., two seconds) to achieve the same effect.

The time information is not limited to "hour," "minute" and "second," but may further include "year," "month" and "day" or "day of a week." With regard also to the structure of the combination switch, the structure of the control circuit, the control procedures, and the control contents, the present invention may be modified in various manners without departing from the scope of the invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A paging apparatus comprising:

time information generating means for measuring time and outputting measured first time information;

a combination switch having at least first, second and third switch positions, said third switch position being different in an operation direction from said first and second switch positions;

mode setting means for setting a time setting mode when a first operation for setting said combination switch at said first switch position and then changing said combination switch to said third switch position is performed, and for setting a paging mode when other operations are performed;

paging means for receiving a paging signal with said paging mode being set by said mode setting means, and informing a user of a call being made when an identification code included in said paging signal corresponds to the apparatus;

time-setting control means for replacing said first time information from said time information generating means with second time information input by a second operation which is a combination of a switching operation between said first and second switch positions of said combination switch and a switching operation to said third switch position, when said second operation is performed while said time setting mode is set by said mode setting means; and time display means for displaying said first time information from said time information generating means when said paging mode is set by said mode setting means, and displaying a predetermined time pattern for entering said second time information when said time setting mode is set.

2. A paging apparatus according to claim 1, wherein said mode setting means sets said time setting mode only when said combination switch is at said first switch position immediately after power is given, and when said combination switch is changed to said third switch position.

3. A paging apparatus according to claim 1, wherein said time display means also serves as message display means for displaying message information included in the paging signal received by said paging means.

4. A paging apparatus according to claim 1, wherein said paging means receives said paging signal with said time setting mode being set by said mode setting means, and, when an identification code included in said paging signal corresponds to the apparatus, said paging means stores information to that effect and informs a user of a call being made after time setting control by said time-setting control means is completed.

5. A paging apparatus according to claim 1, wherein said paging means receives said paging signal with said time setting mode being set by said mode setting means, and, when an identification code included in said paging signal corresponds to the apparatus, said paging means interrupts time setting control by said time-setting control means and informs a user of a call being made.

6. A paging apparatus according to claim 1, wherein said paging means receives said paging signal with said time setting mode being set by said mode setting means, and, when an identification code included in said paging signal corresponds to the apparatus, said paging means interrupts time setting control by said time-setting control means, informs a user of a call being made and returns control to said time setting control by said time-setting control means after call-informing is completed.

7. A paging apparatus according to claim 6, wherein when said paging means receives said paging signal in said time setting mode being set by said mode setting means and said identification code included in said received paging signal corresponds to the apparatus, said paging means interrupts said time setting control by said time-setting control means and informs said user of said call being made, as well as stores a time setting progress until the interruption and returns control to said time setting control by said time-setting control means in accordance with storage contents representing said time setting progress until the interruption after call-informing is completed.

8. A paging apparatus according to claim 1, wherein said paging means receives said paging signal with said time setting mode being set by said mode setting means, and, when an identification code included in said paging signal corresponds to the apparatus, said paging means informs a user of a call being made while said time-setting control means executes time setting control.

9. A paging apparatus according to claim 8, wherein said time display means displays a predetermined time pattern for entering said second time information when said time setting mode is set, and displays information representing occurrence of a call in accordance with a call-informing operation by said paging means while keeping displaying said predetermined time pattern.

10. A paging apparatus according to claim 8, wherein when said paging means receives said paging signal in said time setting mode being set by said mode setting means and said identification code included in said received paging signal corresponds to the apparatus, said paging means informs said user of said call being made while said time-setting control means executes time setting control, and stores message information included in said received paging signal when said message information is addressed to the apparatus; and said time display means displays a predetermined time pattern for entering said second time information when said time setting mode is set, displays information representing occurrence of a call in accordance with a call-informing operation by said paging means while keeping displaying said predetermined time pattern, and reads out said message information stored in said paging means and displays said message information after said time setting control by said time-setting control means is completed.

* * * * *